US009634422B2

(12) United States Patent
Wu et al.

(10) Patent No.: US 9,634,422 B2
(45) Date of Patent: Apr. 25, 2017

(54) PLUG CONNECTOR WITH IMPROVED INSULATIVE HOUSING FOR RETAINING TERMINALS

(71) Applicant: HON HAI PRECISION INDUSTRY CO., LTD., New Taipei (TW)

(72) Inventors: Jerry Wu, Irvine, CA (US); Jun Chen, Kunshan (CN); Xiao Fan, Kunshan (CN); Zhi-Yong Zhou, Kunshan (CN)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 94 days.

(21) Appl. No.: 14/477,891

(22) Filed: Sep. 5, 2014

(65) Prior Publication Data

US 2015/0068803 A1 Mar. 12, 2015

(30) Foreign Application Priority Data

Sep. 6, 2013 (CN) ..... 2013 1 0401807

(51) Int. Cl.

| | |
|---|---|
| ***H01R 13/506*** | (2006.01) |
| ***H01R 13/436*** | (2006.01) |
| *H01R 12/71* | (2011.01) |
| *H01R 13/6581* | (2011.01) |
| *H01R 24/62* | (2011.01) |

(52) U.S. Cl.

CPC ..... *H01R 13/506* (2013.01); *H01R 13/4367* (2013.01); *H01R 12/716* (2013.01); *H01R 13/6581* (2013.01); *H01R 24/62* (2013.01)

(58) Field of Classification Search

USPC ..... 439/701, 607; 174/94 R

See application file for complete search history.

(56) References Cited

U.S. PATENT DOCUMENTS

| | | | | |
|---|---|---|---|---|
| 4,867,707 | A * | 9/1989 | Widdoes | H01R 13/6585 439/497 |
| 5,957,732 | A * | 9/1999 | Ito | H01R 13/4367 439/701 |
| 6,050,859 | A * | 4/2000 | Abe | H01R 13/506 439/701 |

(Continued)

FOREIGN PATENT DOCUMENTS

| | | |
|---|---|---|
| CN | 201374436 Y | 12/2009 |
| CN | 202231195 U | 5/2012 |

(Continued)

*Primary Examiner* — Timothy Thompson
*Assistant Examiner* — Krystal Robinson
(74) *Attorney, Agent, or Firm* — Wei Te Chung; Ming Chieh Chang

(57) ABSTRACT

An electrical connector includes an insulative housing defining a chamber, a number of terminals mounted in the insulative housing, and an insulative block mounted to the insulative housing. Each terminal includes a mounting section mounted in the insulative housing, a contacting section protruding forwards from the mounting portion, and a soldering section protruding backwards from the mounting portion. The contacting sections are exposed to the chamber. The insulative block has a number of guiding ribs and a number of stopping ribs located behind the guiding ribs respectively. Two adjacent guiding ribs define a receiving slot for receiving the soldering section. The stopping rib has a top blocking section.

11 Claims, 7 Drawing Sheets

(56) References Cited

U.S. PATENT DOCUMENTS

| | | | | |
|---|---|---|---|---|
| 7,559,805 | B1 * | 7/2009 | Yi | H01R 13/6658 439/660 |
| 7,695,318 | B1 * | 4/2010 | Wang | H01R 24/60 439/607.01 |
| 8,011,968 | B2 | 9/2011 | Lai et al. | |
| 8,100,725 | B2 | 1/2012 | Su et al. | |
| 8,608,520 | B2 * | 12/2013 | Yuan | H01R 12/53 439/886 |
| 2003/0040226 | A1 * | 2/2003 | Lee | H01R 13/514 439/717 |
| 2004/0014362 | A1 * | 1/2004 | Slack | H01R 24/64 439/620.11 |

FOREIGN PATENT DOCUMENTS

| | | | |
|---|---|---|---|
| CN | 202308489 | U | 7/2012 |
| CN | 202772315 | U | 3/2013 |

* cited by examiner

PLUG CONNECTOR WITH IMPROVED INSULATIVE HOUSING FOR RETAINING TERMINALS

BACKGROUND OF THE INVENTION

1. Field of the Invention

The present invention relates to an electrical connector, and more particularly to a plug connector capable transmitting high frequency signals and stably retaining soldering terminals thereof.

2. Description of Related Art

U.S. Pat. No. 8,011,968, issued on Sep. 6, 2011, discloses an electrical connector including an insulative housing extending along a front-to-back direction, a set of terminals retained in the insulative housing, and a metal shell enclosing the insulative housing. Each terminal includes a mounting portion retained in the insulative housing, a contacting portion continuing forwardly from the mounting portion for connecting with a mating connector, and a soldering portion protruding backwardly from the mounting portion for soldering with a corresponding wire of a cable. The insulative housing has a row of guiding ribs defining a row of receiving slots between every two adjacent guiding ribs. The soldering portions are inserted in the receiving slots, respectively. Because there is not any restriction for preventing the soldering portions from moving backwards or upwards, the terminals may move backwards or upwards to thus undesirably affect their proper functioning.

U.S. Pat. No. 7,695,318, issued on Apr. 13, 2010, discloses an electrical connector including an insulative housing extending along a front-to-back direction, a set of terminals retained in the insulative housing, a positioning bracket mounted to a rear of the housing and holding the terminals, and a metal shell enclosing the housing and the bracket. Each terminal includes a mounting portion, a front contacting portion, and a rear soldering portion. The insulative housing has a row of terminal-mounting holes and associated guiding and stopping rib structures around a rear of the terminal-mounting holes. The bracket has positioning slots separated by associated ribs to properly hold adjacent terminal soldering portions in position.

An electrical connector having an improved rib structure for stably retaining terminal soldering portions is desired.

SUMMARY OF THE INVENTION

Accordingly, an object of the present invention is to provide an electrical connector with an improved rib structure for stably retaining terminals.

In order to achieve the object set forth, the invention provides an electrical connector including: an insulative housing defining a chamber; a plurality of terminals mounted in the insulative housing, each terminal having a mounting section mounted in the insulative housing, a contacting section formed on and protruding forwards from the mounting portion, the contacting section exposed in the chamber, and a soldering section formed on and protruding backwards from the mounting portion, the soldering section; and an insulative block mounted to the insulative housing, wherein the insulative block has a plurality of guiding ribs and a plurality of stopping ribs located at a rear of the guiding ribs, every two adjacent guiding ribs define a receiving slot for receiving the soldering section, and the stopping rib has a top blocking section preventing the soldering sections from moving upwards.

Other objects, advantages and novel features of the invention will become more apparent from the following detailed description when taken in conjunction with the accompanying drawings.

DETAILED DESCRIPTION OF THE PREFERRED EMBODIMENT

Figure 1:
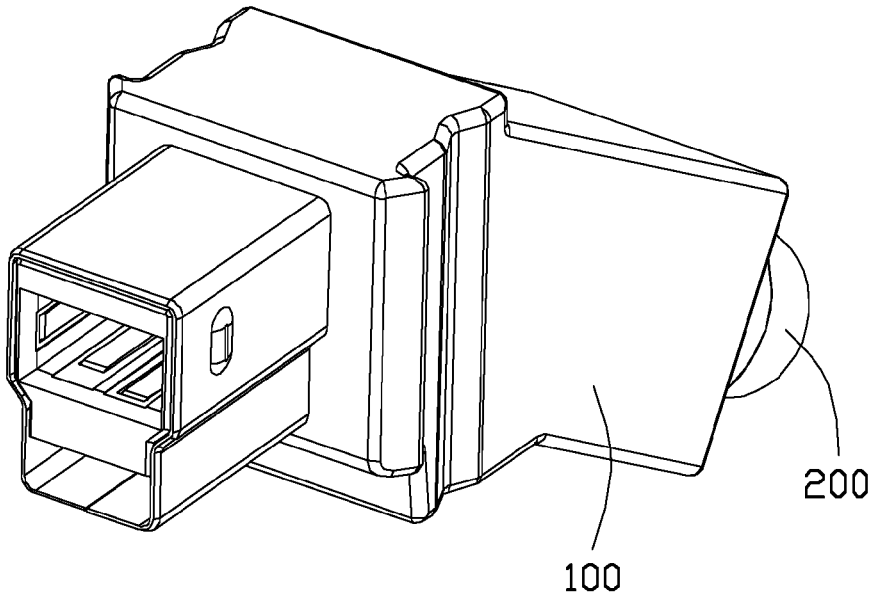
FIG. 1 is a perspective view of an electrical connector connecting with a cable in accordance with the present invention.
Figure 2:
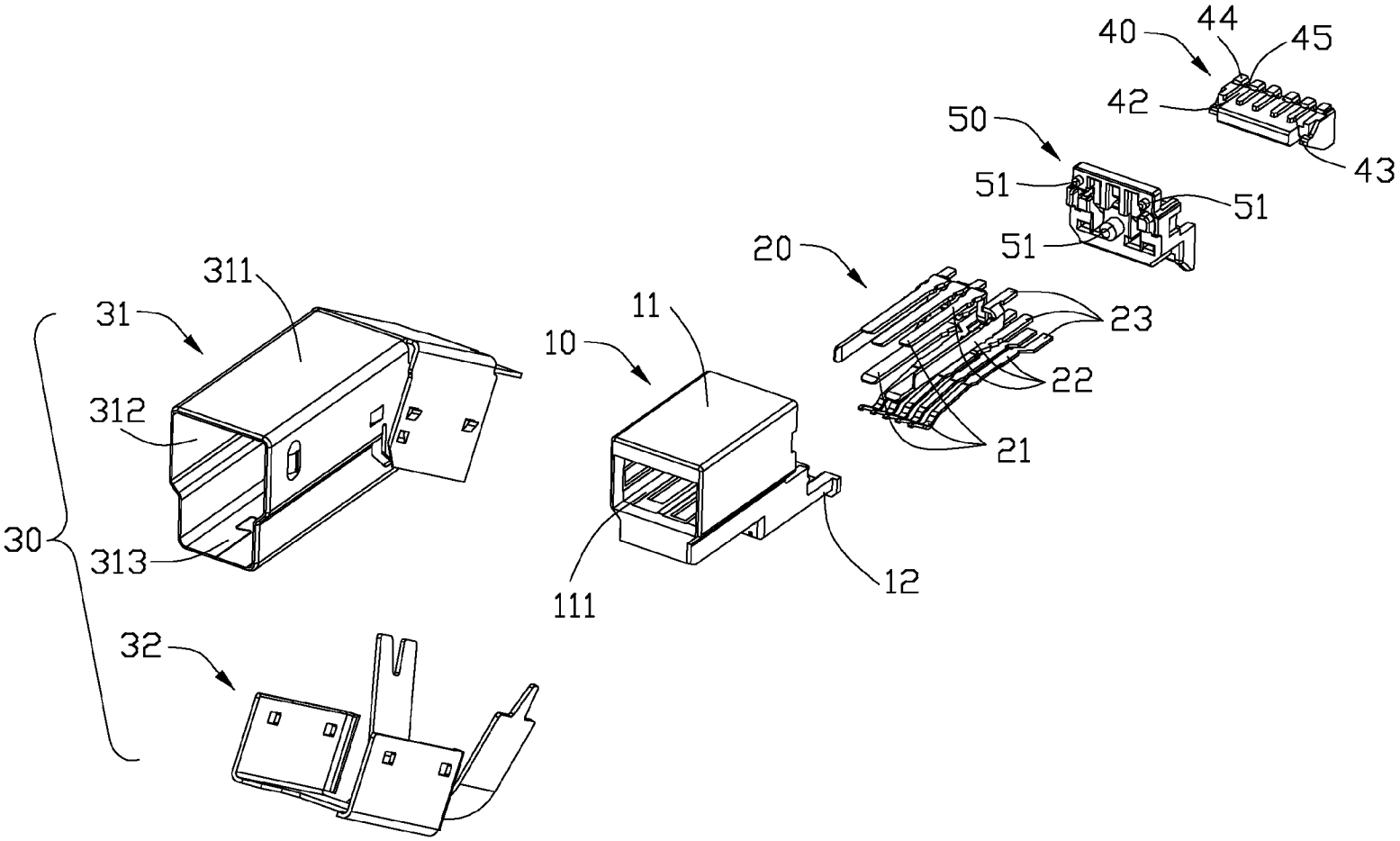
FIG. 2 is an exploded front view of the electrical connector shown in FIG. 1.
Figure 3:
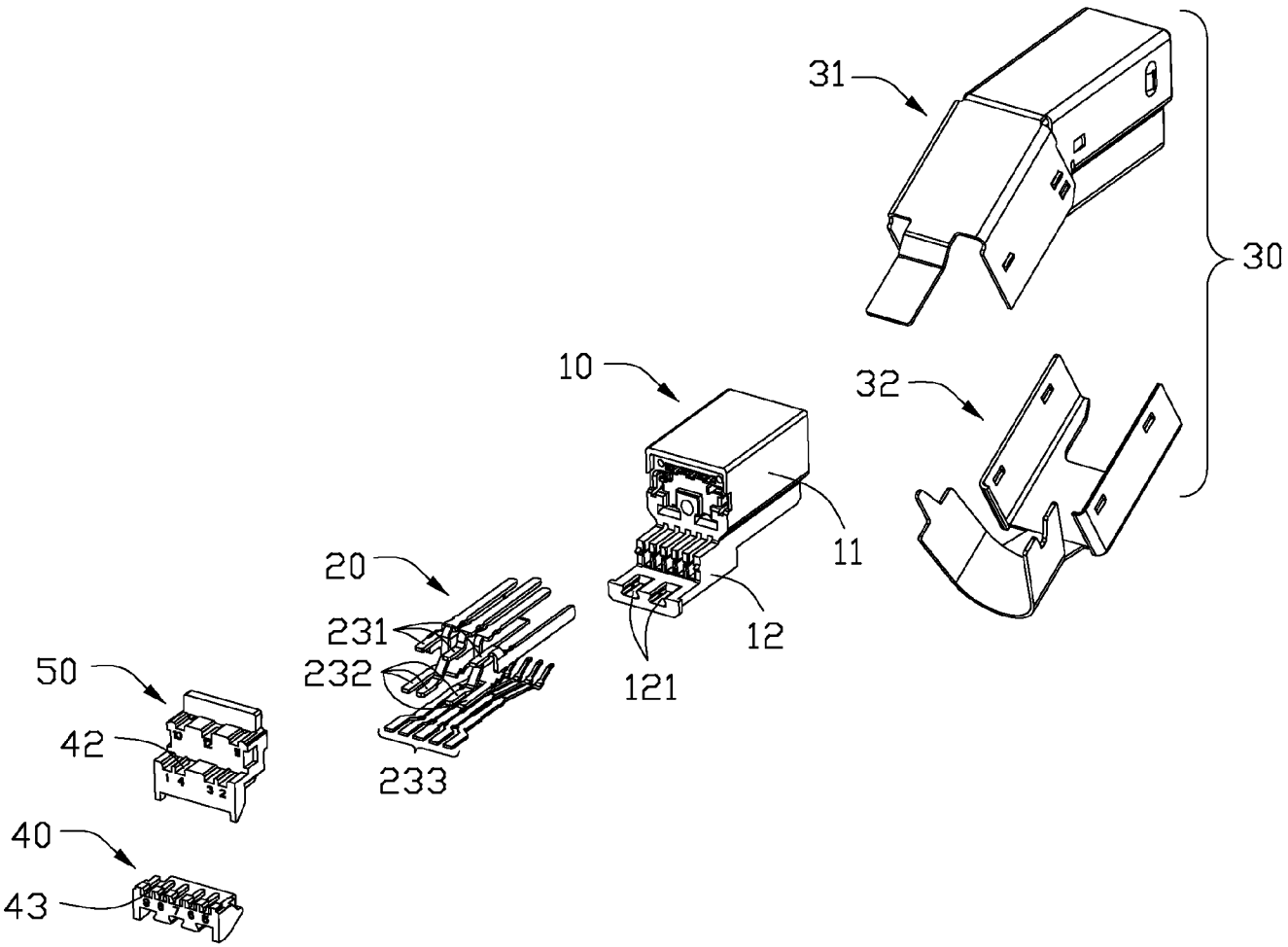
FIG. 3 is an exploded rear view of the electrical connector shown in FIG. 1.
Figure 4:
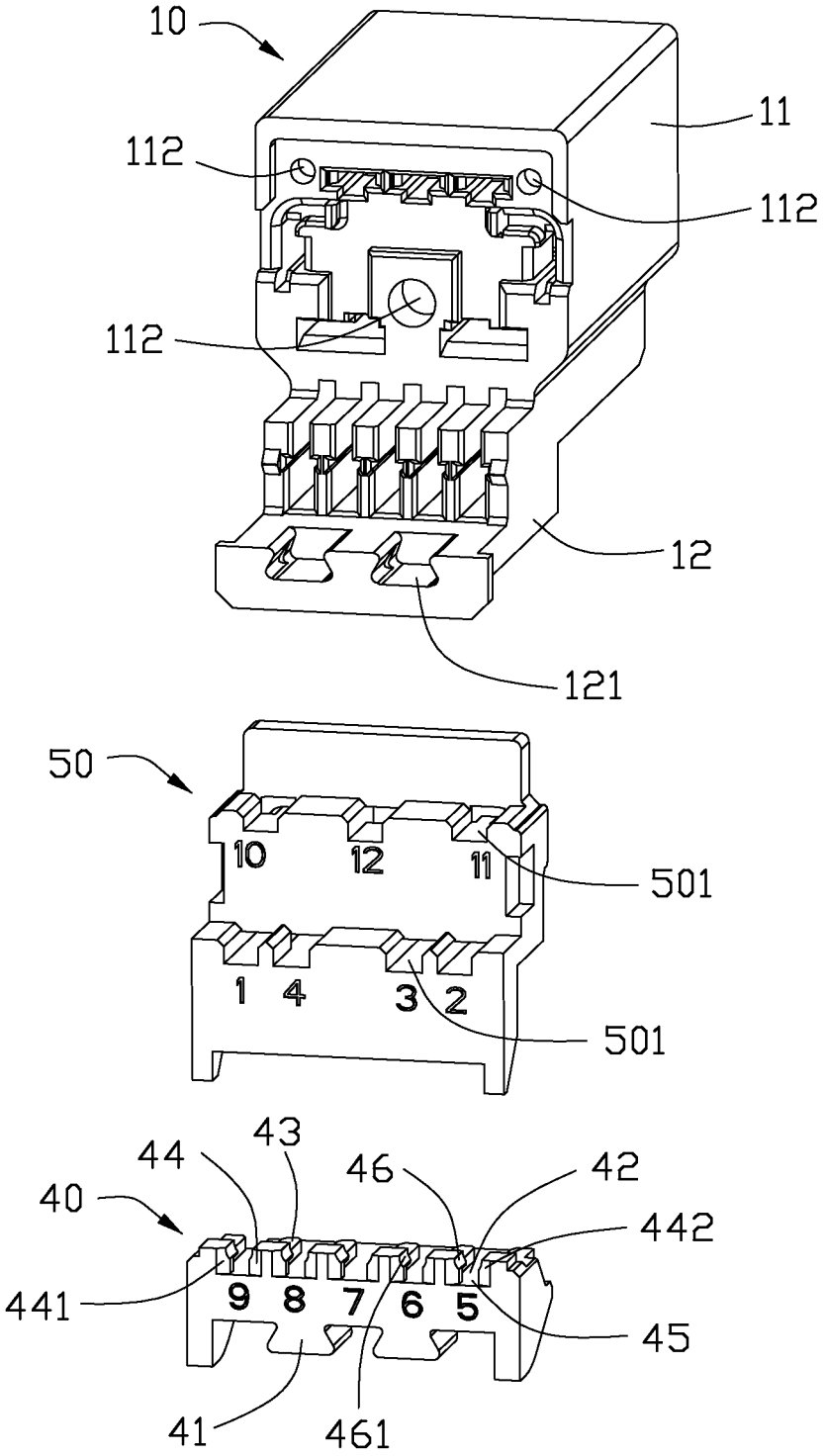
FIG. 4 is a perspective view of an insulative housing, an insulative body, and an insulative block shown in FIG. 2.

Reference will now be made in detail to the preferred embodiment of the present invention.

Referring to FIGS. 1-7, a plug connector 100 in accordance with the present invention connected with a cable 200 is shown. The plug connector 100 may comply with Universal Serial Bus (USB) 3.0 and 2.0 transmission protocols and may be a B-type USB 3.0 plug. The plug connector 100 includes an insulative housing 10, a plurality of terminals 20, an insulative block or lower spacer 40, an insulative body or upper spacer 50, and a shielding shell 30. The terminals 20 are retained in the insulative housing 10 for transmitting USB signals. The shielding shell 30 covers the insulative housing 10, the insulative block 40, and insulative body 50.

The insulative housing 10 includes a main portion 11, an extending portion 12, a receiving chamber 111, and at least one dovetail groove 121. The extending portion 12 extends backwards from a lower section of the main portion 11. The receiving chamber 111 is defined in the main portion 11 and extends along a front-to-back direction. The dovetail groove 121 is recessed downwards from a top surface of the extending portion 12. The insulative block 40 is assembled to a top wall of the extending portion 12. The insulative body 50 is assembled to a rear wall of the main portion 11 and standing on the insulative block 40.

Each terminal 20 has a contacting section 21, a mounting section 22, and a soldering section or tail 23. The mounting section 22 is mounted in the insulative housing 10 and retained in a corresponding mounting hole of the insulative housing 10. The contacting section 21 extends forwards from the mounting portion 22 for mating with a corresponding receptacle connector. The soldering section 23 extends backwards from the mounting section 22. The soldering sections 23 are arranged in three levels, namely a row of first soldering sections 231, a row of second soldering sections 232, and a row of third soldering sections 233 along a top-to-bottom direction. The third soldering sections 233 extend backwards beyond the second soldering section 232, and the second soldering sections 232 extend backwards beyond the first soldering section 231. When wires of the cable 200 are soldered on the soldering sections 23, the three levels soldering portions 23 are disposed in a staggered distribution manner along the front-to-back direction so that the wires are conveniently soldered to the corresponding soldering portions 23. The number of the first soldering sections 231 is less than the number of second soldering sections 232. The number of the second soldering sections 232 is less than the number of third soldering sections 233.

Figure 5:
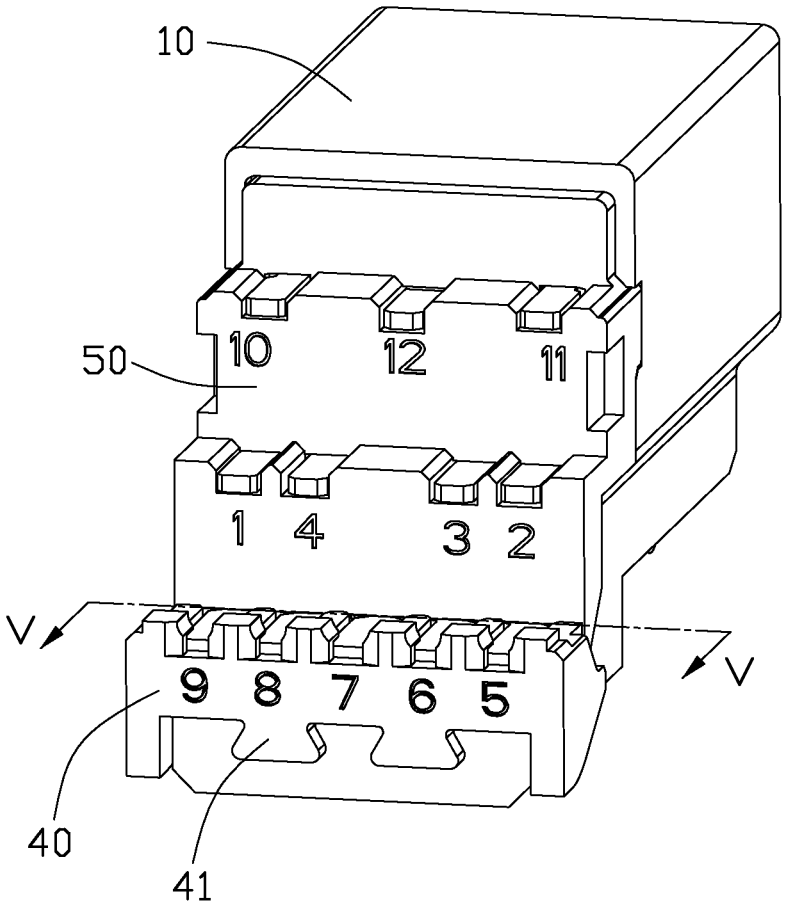
FIG. 5 is a perspective view of the electrical connector shown in FIG. 1 without a shielding shell.
Figure 6:
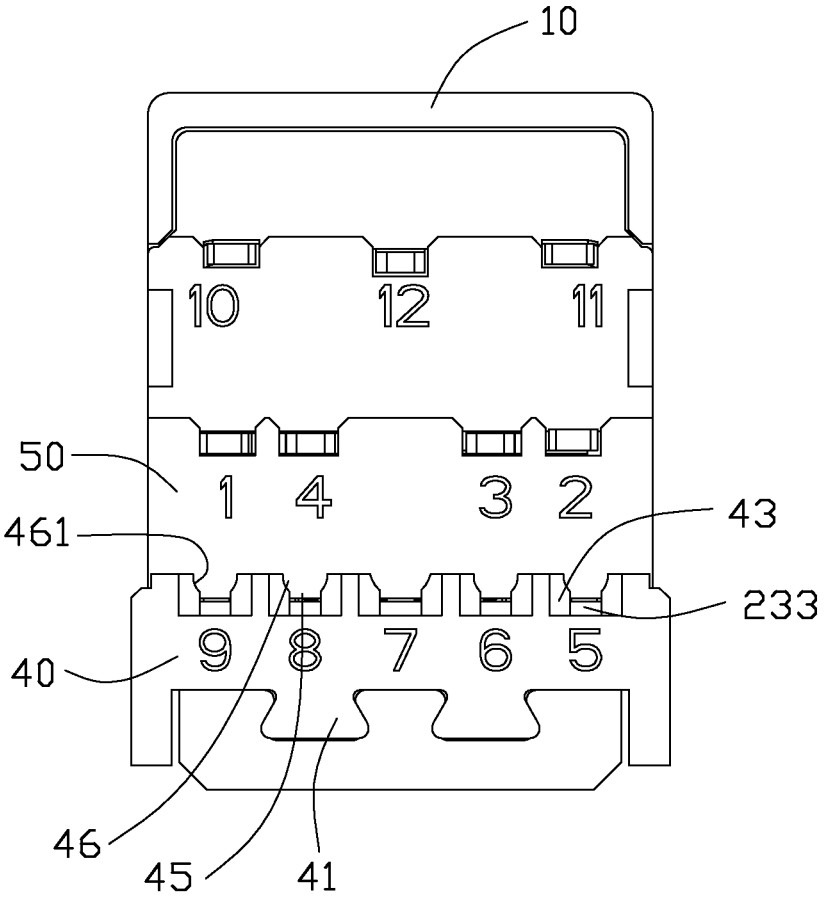
FIG. 6 is a rear view of the electrical connector shown in FIG. 5.
Figure 7:
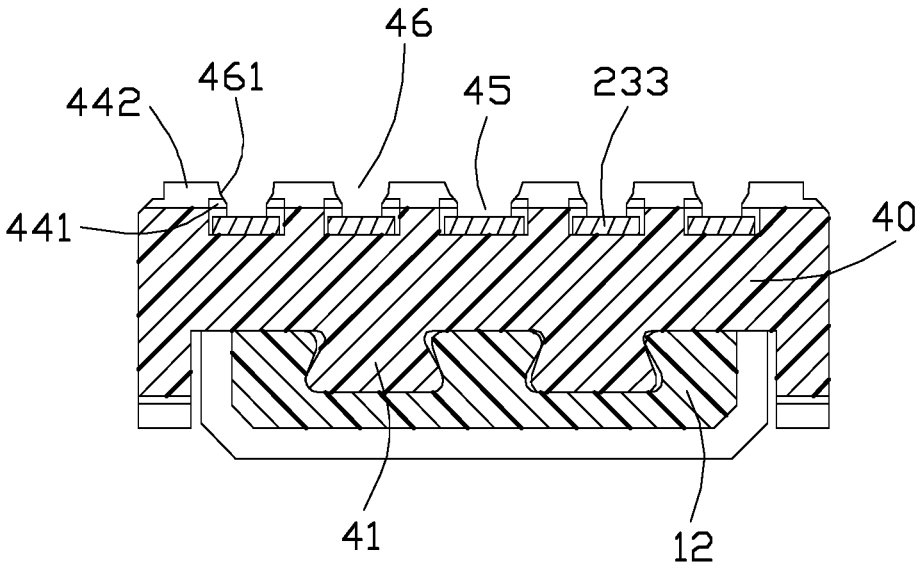
FIG. 7 is a cross-sectional view of the electrical connector, taken along line 7-7 of FIG. 5.

The insulative block 40 discrete from the insulative body 50, has at least one mounting lump 41, a row of guiding ribs 43, a row of stopping ribs 44, and a row of receiving slots 42. The mounting lump 41 protrudes downwards from a bottom wall of the insulative block 40 and is received and retained in the dovetail grooves 121 so as to attach the insulative block 40 to the housing 10 behind the insulative body 50 as shown in FIGS. 5-6 wherein the insulative block 40 forwardly abuts against a lower portion of the insulative body 50. The guiding ribs 43 protrude upwards from a top wall of the insulative block 40. Each receiving slot 42 is defined by two adjacent guiding ribs 43. The third soldering sections 233 are inserted into corresponding receiving slots 42 along the front-to-back direction. Each stopping rib 44 has a rear blocking section 441 and a top blocking section 442. The rear blocking section 441 exposes to a rear room of the receiving slot 42, protrudes upwards from the top wall of the insulative block 40, and prevents the third soldering sections 233 from moving backwards past the receiving slot 42. The top blocking section 442 protrudes forwards from a top portion of the rear blocking section 441, connects with the guiding rib 43, and downwardly confronts the third soldering section 233 to prevent the third soldering section 233 from moving upwards over the receiving slot 42. Therefore, the stopping ribs 44 prevent the terminals 20 from moving backwards or upwards. The stopping rib 44 protrudes upwards over the guiding rib 43. The insulative block 40 also defines a row of lower passageways 45 each located between two adjacent stopping ribs 44. Each receiving slot 42 is wider than the lower passageway 45 along a transverse direction perpendicular to the front-to-back direction and communicates with a corresponding lower passageway 45. Each stopping rib 44 is wider than the guiding rib 43 along the transverse direction and is higher than the guiding rib 43 along a bottom-to-top direction so that an automatic soldering machine solders the wires of the cable 200 to the third soldering sections 233 without scalding the insulative block 40. The insulative block 40 also defines a row of upper passageways 46 each located above a corresponding lower passageway 45. Each upper passageway 46 is defined by two arcuate recesses 461 of two adjacent stopping ribs 44, communicates with a corresponding lower passageway 45, and extends wider than the lower passageway 45 along the transverse direction. The upper passageways 46 are used for wires of the cable 200 easily mounting into the lower passageways 45 and contacting with the third soldering sections 233, respectively.

The insulative body 50 defines two rows of slots 501 receiving the first and second soldering sections 231 and 232, respectively. The main portion 11 defines a retention hole 112 extending along the front-to-back direction. The insulative body 50 has a retention post 51 inserted into the retention hole 112.

The shielding shell 30 includes a first metal shell 31 and a second metal shielding 32 assembled with first metal shell 31. The first metal shell 31 defines a first chamber 312 and a second chamber 313 located below the first chamber 312 and communicating with the first chamber 312. The main portion 11 is disposed within the first chamber 312. Notably, the first chamber 312 cooperates with the corresponding main portion 11 to form the upper mating port, and the second chamber 313 cooperates with the corresponding portion of the housing below the upper mating port to form the lower mating port.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector comprising:

an insulative housing defining a chamber;

a plurality of terminals mounted in the insulative housing, each terminal having:

a mounting section mounted in the insulative housing;

a contacting section formed on and protruding forwards from the mounting portion, the contacting section exposed in the chamber; and a soldering section formed on and protruding backwards from the mounting portion, the soldering section; and an insulative block mounted to the insulative housing, wherein the insulative block has a plurality of guiding ribs and a plurality of stopping ribs located at a rear of the guiding ribs, every two adjacent guiding ribs define a receiving slot to receive the corresponding soldering section, and the stopping rib has a top blocking section downwardly confronting the corresponding soldering section to prevent the corresponding soldering section from moving upwards.

2. The electrical connector as claimed in claim 1, wherein said stopping rib has a rear blocking section protruding downwards from the top blocking section to prevent the soldering sections from moving backwards.

3. The electrical connector as claimed in claim 1, wherein said stopping rib connects with a corresponding guiding rib.

4. The electrical connector as claimed in claim 1, wherein said guiding rib extends along a front-to-back direction, and the stopping rib is wider than the guiding rib along a transverse direction perpendicular to the front-to-back direction.

5. The electrical connector as claimed in claim 1, wherein the guiding ribs and the stopping ribs protrude upwards from a top wall of the insulative block, and the stopping ribs are higher than the guiding ribs along a bottom-to-top direction.

6. The electrical connector as claimed in claim 4, wherein said insulative block defines a row of lower passageways and a row of upper passageways located above corresponding lower passageways, and the lower passageways communicate with the receiving slots respectively.

7. The electrical connector as claimed in claim 6, wherein each lower passageway is located between two adjacent stopping ribs, and each receiving slot is wider than the lower passageway along a transverse direction perpendicular to the front-to-back direction.

8. The electrical connector as claimed in claim 6, wherein each upper passageway is defined by two arcuate recesses of two adjacent stopping ribs, communicates with a corresponding lower passageway, and extends wider than the lower passageway along the transverse direction.

9. The electrical connector as claimed in claim 1, wherein said insulative housing includes a main portion, an extending portion extending backwards from a lower section of the main portion, and a dovetail groove recessed downwards from a top surface of the extending portion.

10. The electrical connector as claimed in claim 9, wherein the insulative block has a mounting lump protruding downwards from a bottom wall of the insulative block and retained in the dovetail grooves.

11. The electrical connector as claimed in claim 1, wherein the soldering sections are arranged in a row of first soldering sections, a row of second soldering sections, and a row of third soldering sections along a top-to-bottom direction, the third soldering sections being received in the receiving slot.

* * * * *